US006018894A

United States Patent [19]

Whitehead et al.

[11] Patent Number: 6,018,894

[45] Date of Patent: Feb. 1, 2000

[54] ROOF RAKE

[75] Inventors: Stephen P. Whitehead, Elgin; Lyle A. Rosine, Aurora; Torrence C. Anderson, Aurora; Michael R. Vogler, Aurora, all of Ill.

[73] Assignee: Suncast Corporation, Batavia, Ill.

[21] Appl. No.: 09/015,086

[22] Filed: Jan. 29, 1998

[51] Int. Cl.[7] ..... E01H 5/02

[52] U.S. Cl. ..... 37/285; 294/54.5

[58] Field of Search ..... 37/265, 278, 284, 37/285; 56/400.11, 400.18, 400.21; 294/19.2, 14, 51, 58, 19.1, 55

[56] References Cited

U.S. PATENT DOCUMENTS

| | | |
|---|---|---|
| D. 213,630 | 3/1969 | Hoxle et al. . |
| D. 214,662 | 7/1969 | Portz et al. . |
| D. 257,210 | 10/1980 | Bonnes . |
| D. 267,468 | 1/1983 | Simms . |
| D. 269,490 | 6/1983 | Germain . |
| D. 284,733 | 7/1986 | Hozumi . |
| D. 291,863 | 9/1987 | Kolonia . |
| D. 296,410 | 6/1988 | Abbott . |
| D. 306,962 | 4/1990 | Schuele . |
| D. 328,553 | 8/1992 | Norton et al. . |
| D. 331,652 | 12/1992 | Wu . |
| D. 350,166 | 8/1994 | Kino . |
| D. 360,564 | 7/1995 | Tisbo et al. . |
| D. 363,653 | 10/1995 | Tisbo et al. . |
| 366,099 | 7/1887 | Hinchman . |
| D. 384,559 | 10/1997 | Tisbo et al. . |
| D. 384,866 | 10/1997 | Tisbo et al. . |
| D. 385,160 | 10/1997 | Tisbo et al. . |
| D. 390,431 | 2/1998 | Whitehead et al. . |
| D. 392,520 | 3/1998 | Tisbo et al. . |
| D. 392,521 | 3/1998 | Tisbo et al. . |
| D. 393,990 | 5/1998 | Whitehead et al. . |
| D. 393,991 | 5/1998 | Tisbo et al. . |
| 678,373 | 7/1901 | Blaser . |
| 864,338 | 8/1907 | Schertzer . |
| 930,660 | 8/1909 | Gifford . |
| 964,453 | 7/1910 | Robarge . |
| 967,270 | 11/1910 | Tiedt . |
| 1,042,352 | 10/1912 | Kohler . |
| 1,260,276 | 3/1918 | Miller . |
| 1,435,061 | 11/1922 | Halsey . |
| 1,839,285 | 1/1932 | Winkie . |

(List continued on next page.)

FOREIGN PATENT DOCUMENTS

| | | |
|---|---|---|
| 234243 | 6/1959 | Australia . |
| 2285163 | 9/1974 | France . |
| 641210 | 8/1933 | Germany . |
| 687817 | 1/1940 | Germany . |
| 369590 | 3/1939 | Italy . |
| 1009947 | 11/1965 | United Kingdom . |
| 1173714 | 12/1969 | United Kingdom . |
| 1424565 | 6/1973 | United Kingdom . |
| 2063142 | 11/1980 | United Kingdom . |

OTHER PUBLICATIONS

Union Fork Hoe Catalog, Dec. 1986, p. 18, Shovel, Item No. 4 (Located in Examiner's Office).

*Primary Examiner*—Robert E. Pezzuto
*Attorney, Agent, or Firm*—Welsh & Katz, Ltd.

[57] ABSTRACT

A user-friendly roof rake is provided to readily remove snow from a roof. The lightweight roof rake has a special plastic blade with a rounded contour to pull, curl and rapidly remove snow from a roof. The roof rake-blade can be reinforced with a series of curved ribs and can have an array of downwardly extending ribs that provide rounded teeth to prevent the lower leading edge of the blade from digging into the shingles or otherwise damaging the roof. The convenient roof rake has an expandable multi-piece handle, which preferably comprises a set of snap-fitting interlocking metal tubes that can be readily assembled and expanded for use, and can be easily dissembled for storage. The metal tubes of the handle can be thermally insulated and more easily gripped with a ribbed plastic sleeve. The outer portions of the roof rake-blade can be reinforced by stabilizing struts or braces.

13 Claims, 4 Drawing Sheets

U.S. PATENT DOCUMENTS

| | | | |
|---|---|---|---|
| 1,931,349 | 10/1933 | Habig . | |
| 3,091,790 | 6/1963 | Schroeder | 37/285 |
| 3,119,596 | 1/1964 | Pratt . | |
| 3,177,026 | 4/1965 | Cowan . | |
| 3,680,641 | 8/1972 | Hein . | |
| 3,773,375 | 11/1973 | Nehls | 294/54 |
| 4,149,744 | 4/1979 | Bonnes . | |
| 4,247,141 | 1/1981 | Grint . | |
| 4,280,727 | 7/1981 | Germain . | |
| 4,538,847 | 9/1985 | Lapshansky . | |
| 4,655,494 | 4/1987 | Eads et al. . | |
| 4,690,447 | 9/1987 | Adams . | |
| 4,848,073 | 7/1989 | Germain et al. . | |
| 4,878,704 | 11/1989 | Jacanin, Jr. et al. . | |
| 4,991,324 | 2/1991 | Fine et al. . | |
| 4,993,768 | 2/1991 | Ewen . | |
| 5,228,734 | 7/1993 | Pollastro . | |
| 5,419,600 | 5/1995 | Tisbo et al. . | |
| 5,435,063 | 7/1995 | Russo . | |
| 5,465,510 | 11/1995 | Goodnough et al. | 37/285 |
| 5,524,369 | 6/1996 | Phillips | 37/285 |
| 5,676,413 | 10/1997 | Hauck | 294/54.5 |
| 5,749,613 | 5/1998 | Rapp | 294/58 |
| 5,810,408 | 9/1998 | Armstrong | 294/57 |

ROOF RAKE

BACKGROUND OF THE INVENTION

This invention pertains to snow tools and, more particularly, to roof rakes for removing snow from roofs.

In Buffalo, Syracuse, Rochester, Minneapolis, St. Paul, and elsewhere, heavy accumulation of snow can damage the roof and other parts of homes and other buildings. As snow accumulates on the roof, the weight of the snow can crack or rupture sections of the roof. As the snow melts from the heat of the building or from the sun, the melted snow will leak through the cracks and openings in the shingles and roof, staining the ceiling, wallpapers, walls and carpeting in the home. This becomes aggravated when the snow or ice blocks the gutters and the snow backs up through the bottom and cracks in the shingles. This situation also becomes aggravated when snow is very heavy, wet and slushy.

In an effort to alleviate this problem, roof rakes were developed. Roof rakes can be used to pull and remove snow from the roof. Roof rakes have long handle sections that allow the user to reach and rake the roof from the ground or a ladder or from some other remote location. Conventional roof rakes have aluminum or steel blades and wooden or aluminum handle sections. The handle sections are typically bolted together and are difficult and cumbersome to assemble in cold and wet weather. The metal blades of conventional roof rakes can tear or otherwise damage the shingles of the roof.

Small amounts of snow can be readily removed from sidewalks, stairs, roofs, and driveways with a snow shovel. Snow shovels are good all around snow tools. Typically, snow shovels have a generally flat blade with a very slight curvature. Snow shovels are useful to shovel, lift, raise and throw light snow away from the sidewalk, stairs, roofs, or driveway. If the snow is deep, heavy, or slushy, other types of snow tools are better, safer and more productive than standard snow shovels. Moreover, lifting heavy snow with a standard snow shovel may cause back injuries and sometimes heart problems for some people.

Snow pushers have a rounded or curved blade which are useful to push heavy or deep snow and slush away from sidewalks and driveways. Snow pushers can be very heavy. Snow pushers are not generally useful to remove snow from roofs. Persons using snow pushers and snow shovels have to be careful not to fall off the edge of the roof. Furthermore, the deep curvature of pusher blades, however, are not generally useful to lift (raise) and throw snow and slush, which remain after the bulk of the snow and slush has been pushed away. Furthermore, many snowfalls, such as 2½ inches to 5 inches of snow, are too deep to comfortably use only a snow shovel, but too shallow (not deep enough) to use only a snow pusher. Combination snow shovels and snow pushers can be useful on sidewalks and driveways for such purposes.

Scrapers are useful to scrape, cut and chop ice from sidewalks and driveways. Smaller scrapers are useful to scrape ice from vehicle windows and windshields. Ice can accumulate on sidewalks and driveways from ice storms or from snow which has melted during the day and freezes at night when the temperature drops. Icy sidewalks and driveways can be very dangerous and slippery. It is often difficult to walk and safely drive with full control on icy pavements. If snow falls and accumulates on the ice, the underlying layer of ice can be treacherous. Once the ice is chopped or scraped, it can be scooped, shoved and removed with a snow scoop. It is best to avoid using ice scrapers on roofs, because they may puncture, tear and otherwise damage the shingles.

The snow shovel and scoop are well known hand tools used primarily for shoveling, scooping and removing snow. An important consideration and concern with snow shovels and scoops are the strength to weight ratio. In the past, the stronger a snow shovel and scoop, the heavier it was, due to the amount of material mass required for rigidity. The weight of conventional iron and steel snow shovel blades and scoop blades are burdensome, awkward and inconvenient, especially if the person lifting the blade is young, elderly or not trained in proper lifting techniques. If the snow shovel blade and scoop blade is made too thin, it will bend under load. Therefore, conventional prior snow shovels and scoops have been constructed of thick iron or steel which provides a heavy awkward hand tool that is hefty and burdensome to operate.

A snow shovel blade, scoop blade, roof rake blade, and ice scraper blade, are usually subjected to impact forces and abrasion during use from impacted snow, ice, the underlying pavement, shingles, etc., which can pit, corrode, or otherwise damage the snow shovel blade, scoop blade and ice scraper blade. Furthermore, salt used to melt ice and water from slush and melting snow can accelerate rust and degradation of conventional iron snow shovels, scoops, and ice scrappers. These factors can cause premature failure of the snow shovel, snow scoop, ice scrapper, and roof rakes.

A roof rake used primarily for removal of snow from roofs is unique in that the consumer seeks a large, but lightweight blade. For these reasons, in place of an iron or steel blade, some roof rakes are manufactured with aluminum blades. While aluminum blades do not rust, the are much weaker and flimsier than iron and steel and often requires greater thickness or reinforcement in order to withstand the loads, forces, stress and strain of pulling and removing snow. Without reinforcement of an aluminum blade to prevent counter-flexing, such as stepping on the back of the blade, the aluminum blade can bend in half thereby ruining the roof rake.

Another problem with prior roof rakes is that the convention long heavy shafts comprising the handle adds enormous weight and bulkiness to the roof rake. Metal handles comprising metal shafts made of iron and steel have been used. While iron shafts are strong, they can readily corrode due to moisture, snow and sleet. Futhermore, iron or steel shafts are very cold due to the inability to compensate for the cold surrounding ambient temperature. In an effort to improve the ease of use and decrease the weight of roof rakes, roof rakes have been made with aluminum handles (shafts). It has also been common practice to make the shafts of the handle from wood. However, a problem with wood is that unless properly treated, water can rot the wood especially where the parts are fastened or coupled together.

Some snow shovels have been molded entirely from plastic, which does not rot, rust, or retain cold as its wood and metal counterparts. However, the problem with plastic is strength. Early snow shovels with plastic blades were somewhat flimsy and did not wear well. A plastic shaft may flex causing the shaft to bend since the shaft becomes a fulcrum point during use. Furthermore, plastic snow shovels with smooth, rounded handles can also be slippery and difficult to hold when wet. A blade made of plastic further presents a number of problems, including control of flexing and wear.

In order to manually removing snow from roofs, different amounts of effort are often required to remove the snow, depending on the depth, temperature, fluffiness, amounts of slush, water, ice and texture of the snow to be removed.

Sometimes, young women, men, and elderly people may become overburdened and frustrated by the weight and bulkiness of a conventional roof rake when removing snow. Also, conventional roof rakes can be too heavy, awkward and cumbersome to use for many people.

It is therefore, desirable to develop an improved roof rake which overcomes most, if not all, of the preceding problems.

SUMMARY OF THE INVENTION

An improved, user-friendly roof rake is provided to pull and remove snow from a roof. Advantageously, the inventive roof rake is lightweight, sturdy, and strong. Desirably, the novel roof rake is comfortable, safe and convenient. The portable roof rake is also easier to use and assemble than conventional roof rakes. Furthermore, the dependable roof rake is economical, efficient and effective.

The improved roof rake has a plastic blade for pulling and removing snow from a roof. The rounded contour of the blade channels the snow to curl up and back onto itself instead of up and over the top of the roof rake. The contoured blade brings the snow down off the roof instead of depositing it back on the roof. The blade of the roof rake is also contoured to allow the user to easily slide, maneuver and steer the roof rake up and over the snow covered roof to the area from which snow is to be removed. The blade can have ribs, preferably curved V-shaped ribs, for enhanced strength. In the preferred form, the roof rake has a series of ribs or protuberances extending below and across the bottom leading edge of the blade to prevent the bottom edge of the roof rake from digging into and damaging the shingles and surface of the roof.

In order to steer and pull the blade of the roof rake, the roof rake has an elongated multi-piece expandable handle. The expandable readily graspable handle is operatively connected to the snow blade of the roof rake to better and more easily maneuver the roof rake and blade. The multi-piece handle has at least two shafts, preferably three shafts, which connect to each other to extend the length of the handle and roof rake. In the preferred form, the shaft comprise longitudinally aligned metal tubes with snap lock assemblies that interlockingly connect and releasably couple the shafts together.

In order to more easily grip the handle and thermally insulate the user's hands, one or more of the metal tubes can be annularly surrounded or encased by plastic sleeves. The plastic sleeves can also have ribs, furrows, ridges, or fluting. The plastic sleeve can also have finger-gripping portions such as knurling, protuberances, or finger-gripping grooves, which extend substantially parallel to the axis of the sleeve and handle towards the blade. Desirably, the shafts providing the handle sections of the roof rake have a metal core comprising a metal tube positioned within a plastic sleeve. The metal tubes can be steel, iron or preferably aluminum pipe.

In order to reinforce, rigidify, brace, and byrther stabilize the blade of the roof rake, rods or struts can be provided which secure the outer portions of blade to the handle.

A more detailed explanation of the invention is provided in the following description and appended claims taken in conjunction with the accompanying claims.

DETAILED DESCRIPTION OF THE PREFERRED EMBODIMENTS

Figures 1, 9:
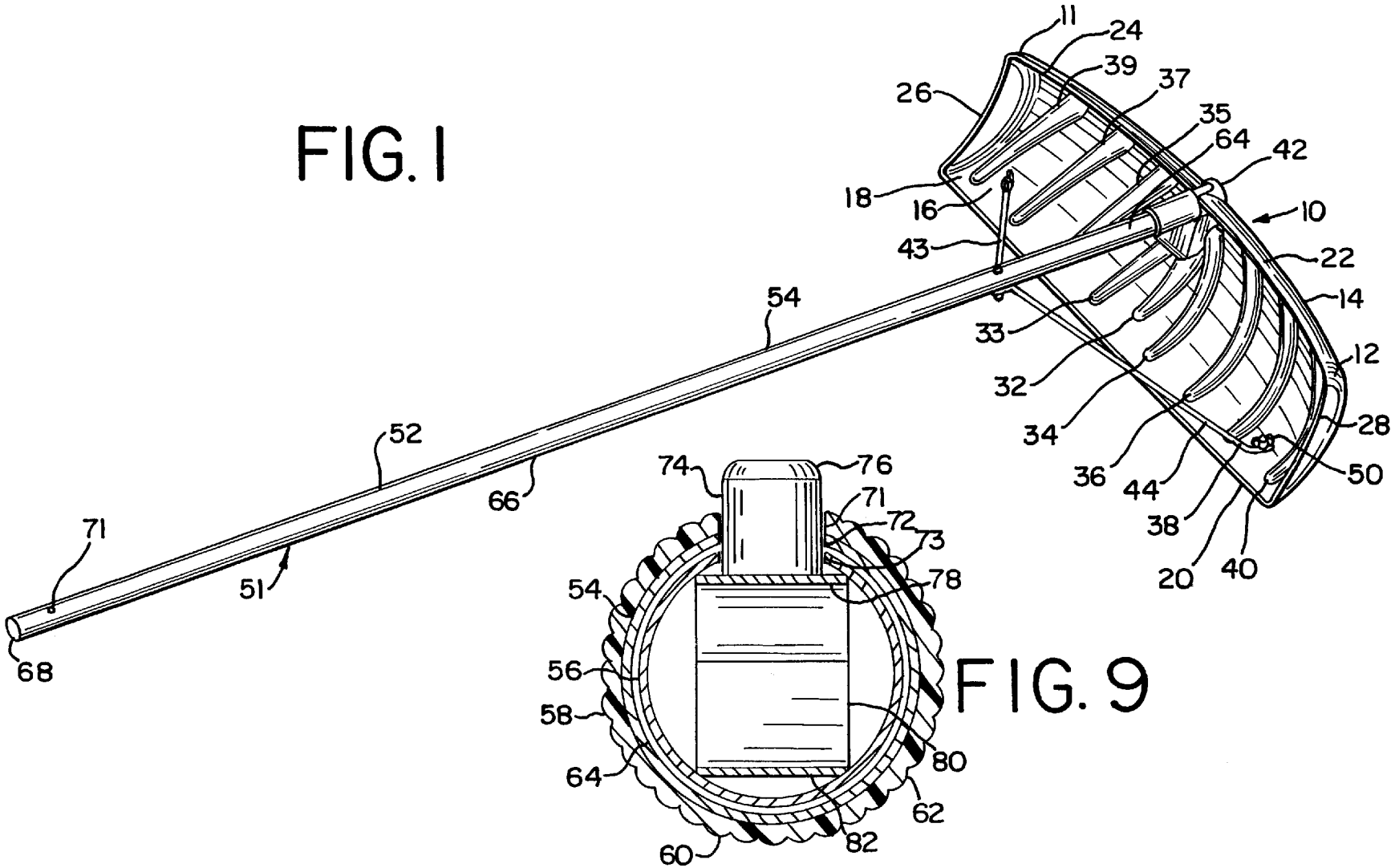
FIG. 1 is a perspective view of a roof rake in accordance with principles of the present invention.
FIG. 9 (on the same sheet as FIG. 1) is an enlarged cross-sectional view of a snap lock assembly taken substantially along line 9—9 of FIG. 8.
Figure 2:
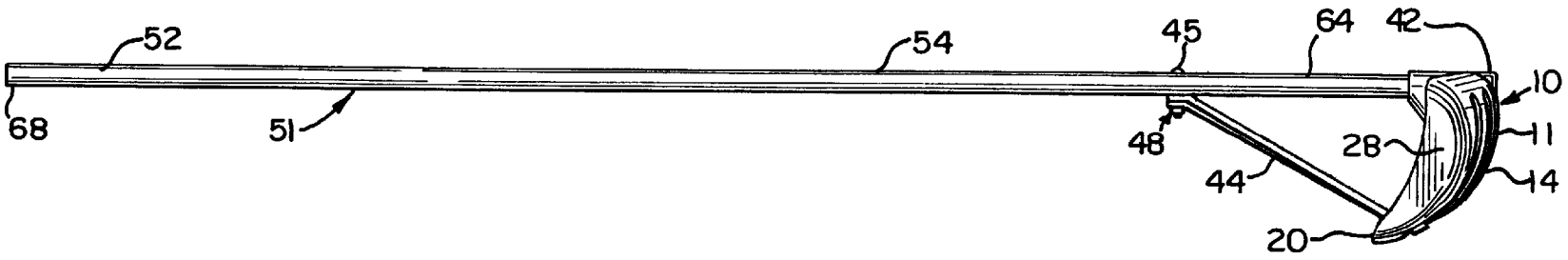
FIG. 2 is a side view of the roof rake.
Figure 4:
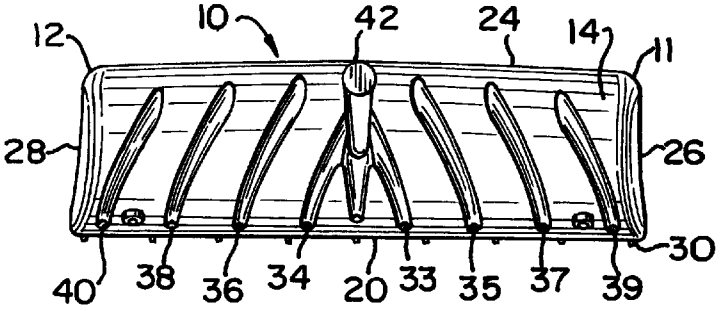
FIG. 4 is a front view of the roof rake.
Figure 3:
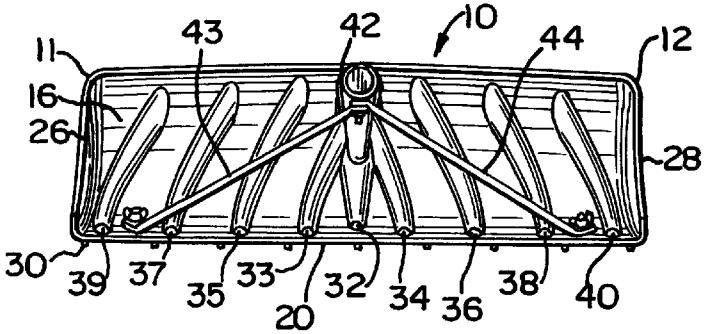
FIG. 3 is a back view of the roof rake.
Figure 5:
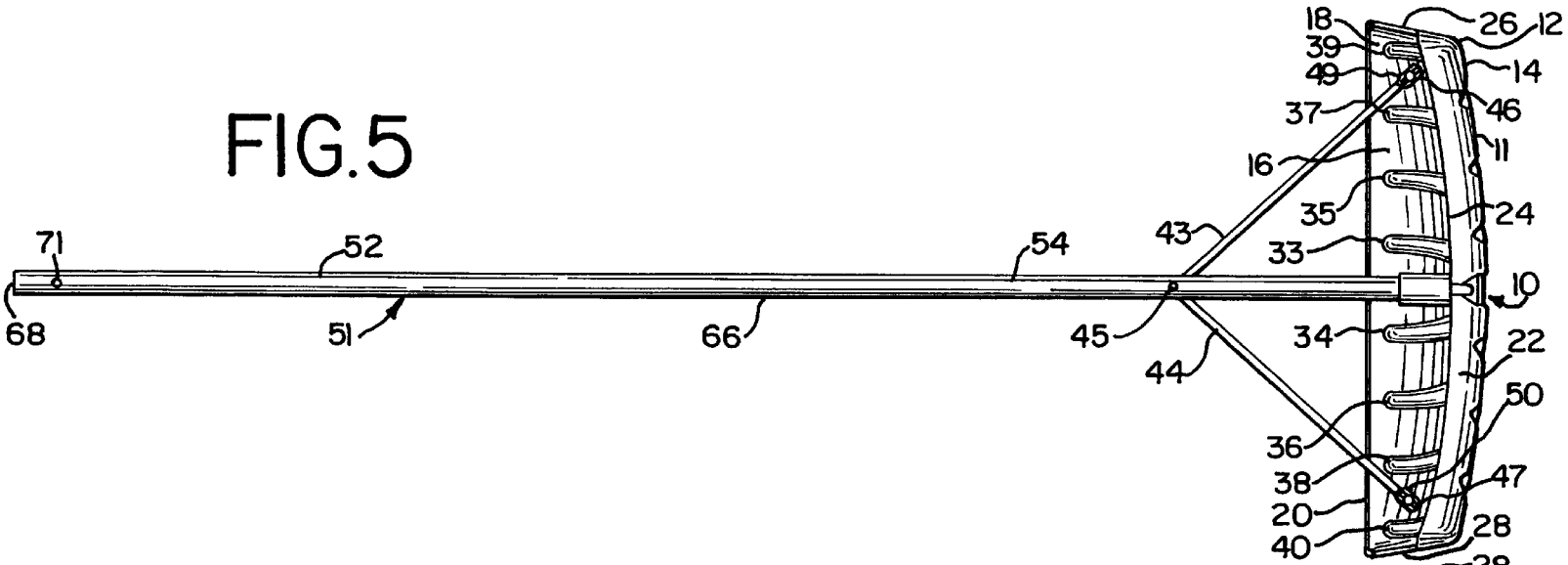
FIG. 5 is a top view of the roof rake.
Figure 6:
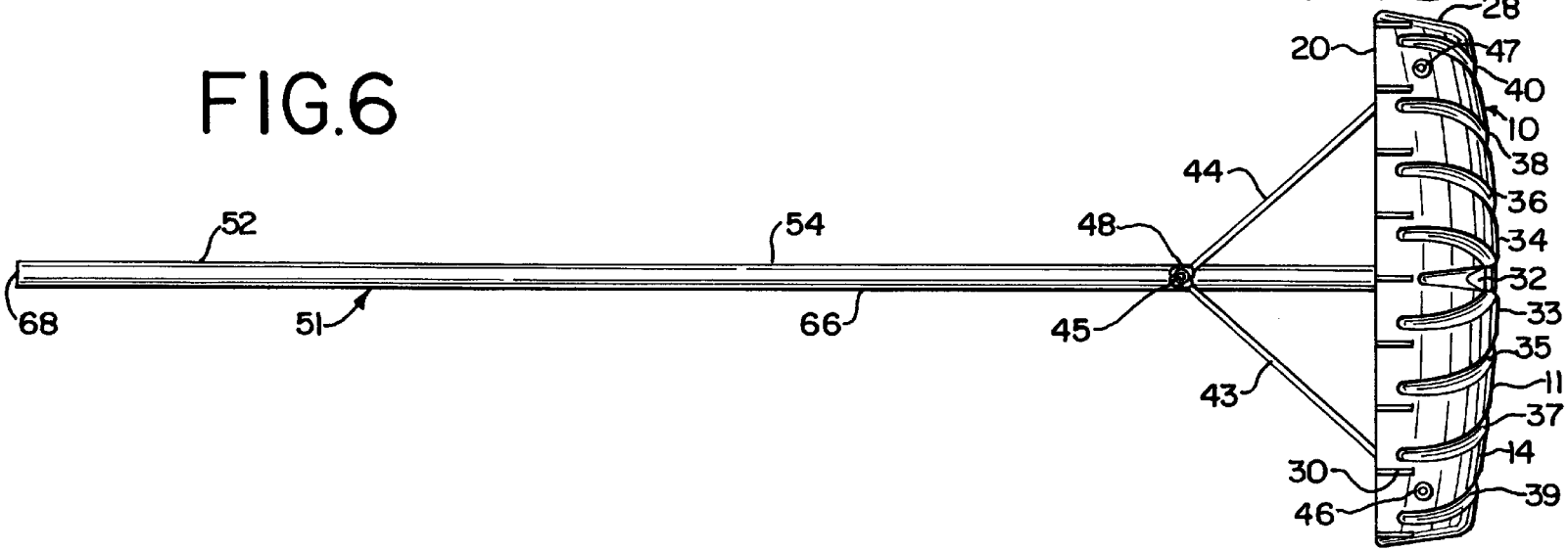
FIG. 6 is a bottom view of the roof rake.

An expandable, telescoping, handheld, manual, portable, retractable snow removal roof rake 10 is provided to remove snow and slush from roofs. Advantageously, the roof rake can be readily assembled, telescoped and expanded to manually pull, shovel, and remove snow from roofs from remote locations, such as the ground or a ladder, or from other places. Desirably, the roof rake can be disassembled and retracted to a compact storage position for storage and shipment.

The roof rake can have a blade assembly 11 (FIGS. 1–7) with a snow removal curved roof rake-blade 12 fabricated of impact-resistant plastic, such as polypropylene, polyethylene, polyvinyl chloride, or graphite-impregnated plastic. The roof rake-blade has a rounded contour with a front convex blade surface 14 (front face) to push, and engage, snow and a back (rear) convex blade surface 16 (back face) to pull, curl, rake and remove snow from a roof. The blade has a lower bottom portion 18 that provides a leading edge 20 and has an upper portion 22 that provides a trailing top edge 24. The roof rake-blade also has curved sidewalls 26 and 28 which extend between and are integrally connected to the upper and lower portions of the blade. The curved sidewalls help contain channel and collect the snow on the back blade surface during pulling of the roof rake.

Desirably, the blade of the roof rake has a set, series or array of aliquotly spaced rounded plastics protuberance 30 (FIGS. 3, 4 and 6) which extend integrally downwardly from the lower leading edge of the roof rake-blade to prevent the lower leading edge from digging into the shingles or otherwise damaging the roof. The protuberances can comprise downwardly extending ribs, teeth, tines or rudders.

The roof rake-blade further has inverted V-shaped bifurcated ribs or ridges 32–40 (FIGS. 1 and 3–7) also referred to as reinforced ribs or curved reinforcement ribs. The inverted V-shaped ridges comprising the ribs of the roof rake-blade project integrally outwardly and rearwardly of the back blade surface and extend between the lower and upper portions of the blade to enhance the structural strength and integrity of the roof rake-blade. The blade's ribs are generally V-shaped as viewed from the front surface of roof rake-blade. Preferably, the ribs include curved flared ribs 33–40 which converge laterally inwardly away from the blade's sidewalls and toward the axis of the handle and centerline of the roof rake-blade in a direction towards the blade's upper portion. The blade's ribs facilitate pulling, shoveling and channeling of the snow towards the top edge of the upper portion of the blade's back surface. The blade's ribs also help prevent the channeled snow from falling off the leading edge of the blade. Desirably, the blade's angled ribs throw and pull more snow reawardly creating a powerful snowplow effect The blade's ribs include: a center rib 32, inboard ribs 33 and 34, intermediate ribs 35–38 and outboard ribs 39 and 40.

The ribs can have rounded apexes. The inboard ribs converge towards and are integrally connected to a intermediate portion of the blade's center rib. The outboard ribs are spaced between the sidewalls and the intermediate ribs and curve outwardly towards the sides and bottom leading edge of the blade's back surface. The center rib extends along the centerline of the blade and in alignment with the axis of the handle (handle assembly).

The upper portion of the center rib is deeper than the lower portion of the center rib and forms a socket 42 (FIG. 1), which provides a coupler or shaft coupling, to snugly receive the lower end of the forward blade assembly-engaging shaft of the handle. The socket (coupler) of the roof rake-blade extends integrally reawardly from the top portion of the blade's back surface.

The outer lateral portions of the roof rake-blade can be reinforced, braced, rigidified, and stabilized by metal rods 43 and 44 which provide reinforcement braces and stabilizing struts. The braces enhance the longevity and useful life of the roof rake-blade. The rods can be made of galvanized steel, stainless steel, carbon steel, iron and its alloys, aluminum, or other metal. In the illustrated embodiment, the reinforcing braces comprise rearwardly converging rods that are secured to the lower outer lateral portions of the roof rake-blade and the handle adjacent the socket by bolts 45–47 (FIG. 6) and nuts 48–50 (FIGS. 5 and 6) or other fasteners.

An elongated expandable composite handle assembly 51 (FIG. 7) comprises a multipiece handle 52 which can readily snap fit together in an expanded position to steer, maneuver, and pull the roof rake-blade in order to remove snow from a roof from a remote location, such as the ground or a ladder, and can be easily disconnected (disassembled) for storage. The handle is preferably straight and comprises snag-fitting, interlocking manually grippable shafts or shanks 54–56 including a forward blade assembly-engaging shaft (shank) 54, an intermediate adjoining shaft (shank) 55 and a rearward adjoining shaft (shank) 56. In order to decrease the overall weight of the roof rake but improve the structural strength, bending resistance, torsion and torque capacity of the handle, the shafts preferably comprise metal tubes. In the preferred embodiment, the metal tubes are the same length. Desirably, the shafts are hollow and tubular to decrease the weight of the roof rake and handle assembly and can comprise a metal pipe made of steel, iron, or preferably aluminum.

Figure 8:
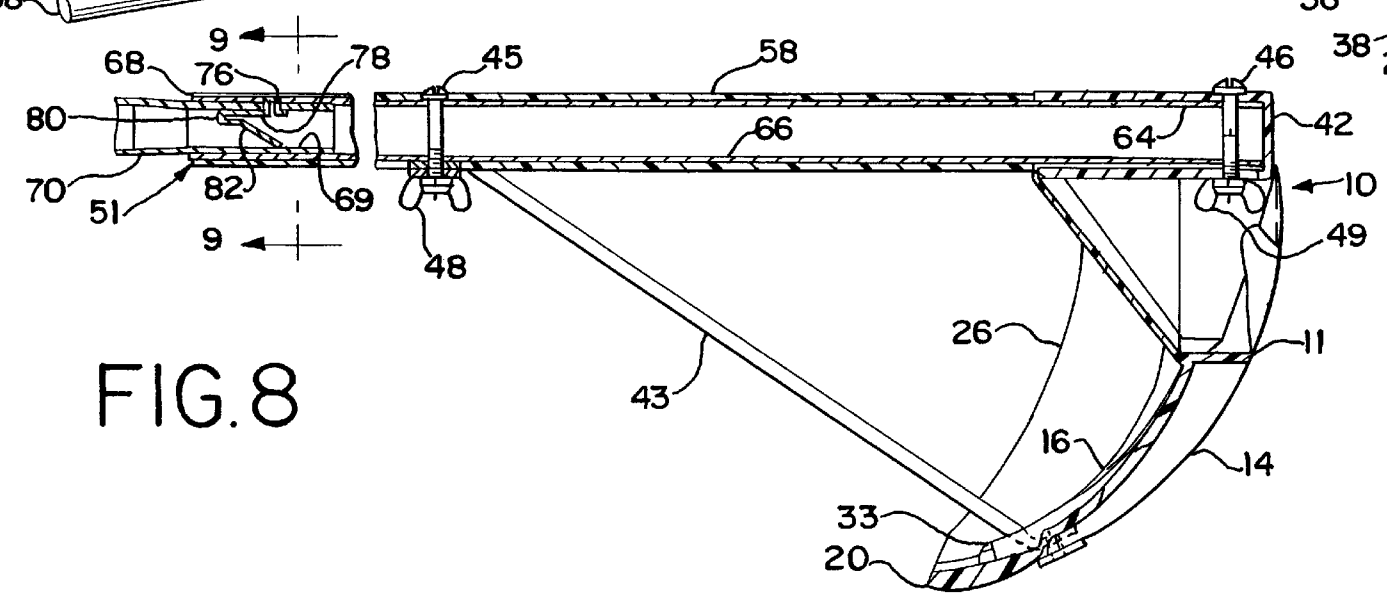
FIG. 8 is a cross-sectional view of the roof rake taken substantially along line 8—8 of FIG. 7.

The handle assembly can include ribbed plastic sleeves 58 (FIGS. 8 and 9) which provides a protective cover that annularly surround, encircle, encase, and thermally insulate at least one and preferably all of the metal tubes. The plastic sleeving can overcoat and shrink fits the metal tubes. The sleeves can comprise plastic, resin, axially (longitudinally) lined sleeves which provide extruded fluted tubes or sheaths of impact-resistant plastic, such as polypropylene, polyethylene, polyvinyl chloride, or graphite-impregnated plastic. In order to enhance gripping, the sleeves can have elongated aliquotly and circumferentially spaced, parallel ribs 60 (FIG. 9) which provide longitudinally, raised, rounded convex, finger-gripping pads or ridges in the axial or longitudinal direction. The ribs of the tubular sleeves can be separated by elongated grooves 62 which provide finger-gripping slots or slits that extend parallel to the axis of the shaft and towards the blade. The grooves provide parallel fluting or farrows which can extend along the entire length of the exterior surface of the sleeves to further enhance gripping of the roof rake. The sleeves can have 36 circumferential ribs and flutes (fluting) which cooperate with each other to provide convex pads. Each rib of the sleeve is rounded and can extend for 10 degrees. The sleeves can extend for most of the length of the tubes. The metal tubes provide interior metal cores which are snugly positioned and press fit within the exterior plastic sleeves. The handle assembly can be semi-rigid, yet flexible to withstand impact forces, bending and torque associated with pulling and removing snow from a roof.

Each of the shafts have opposite end portions. The forward blade assembly-engaging shaft has a front (forward) end portion 64 (FIG. 8) which is positioned within and fixedly secured to the socket that provides the handle-receiving coupling joint of the blade assembly. The forward blade assembly-engaging shaft has an elongated tubular body 66 that extends between the front end portion and a back end portion 68. The front (forward) adjoining end portion 69 (FIG. 7) of the intermediate shaft can be crimped and of reduced diameter to telescopically engage and fit within the back end portion of the forward shaft. The intermediate shaft has a tapered neck 70 adjacent the front adjoining end portion. Preferably, the maximum outside diameter of the front adjoining end portion of the intermediate shaft is less than the minimum inside diameter of the back end portion of the forward shaft so that the front adjoining end portion of the intermediate shaft can slide and fit within the back end portion of the forward shaft. The intermediate shaft has an elongated tubular body that extends between the front and back end portions of the intermediate shaft.

The back end portion of the forward shaft and the front adjoining end portion of the intermediate shaft provide connecting portions with aligned pushbutton-receiving apertures or holes 71–73 (FIG. 9). The front adjoining end portion of the intermediate shaft has a connector assembly which preferably comprises a snap lock assembly 74 (FIG. 9) with a manually depressible spring-biased pushbutton 76 that provides a snap button. The pushbutton is cantilevered and integrally connected to one diverging end 78 (FIGS. 8 and 9) of an articulated, generally U-shaped leaf spring 80. The other diverging end 82 of the leaf spring is wedged against, welded or otherwise securely fixed and connected to the interior surface of the front adjoining end portion of the intermediate shaft. The pushbutton and leaf spring can be made of plastic but are preferably made of metal. The pushbutton of the intermediate shaft snap fits, is inserted and extends through the pushbutton-receiving apertures of the front adjoining end portion of the intermediate shaft and the back end portion of the forward shaft to securely connect, interlockingly engage and firmly lock the forward and intermediate shafts of the handle assembly in an expanded position.

Figure 7:
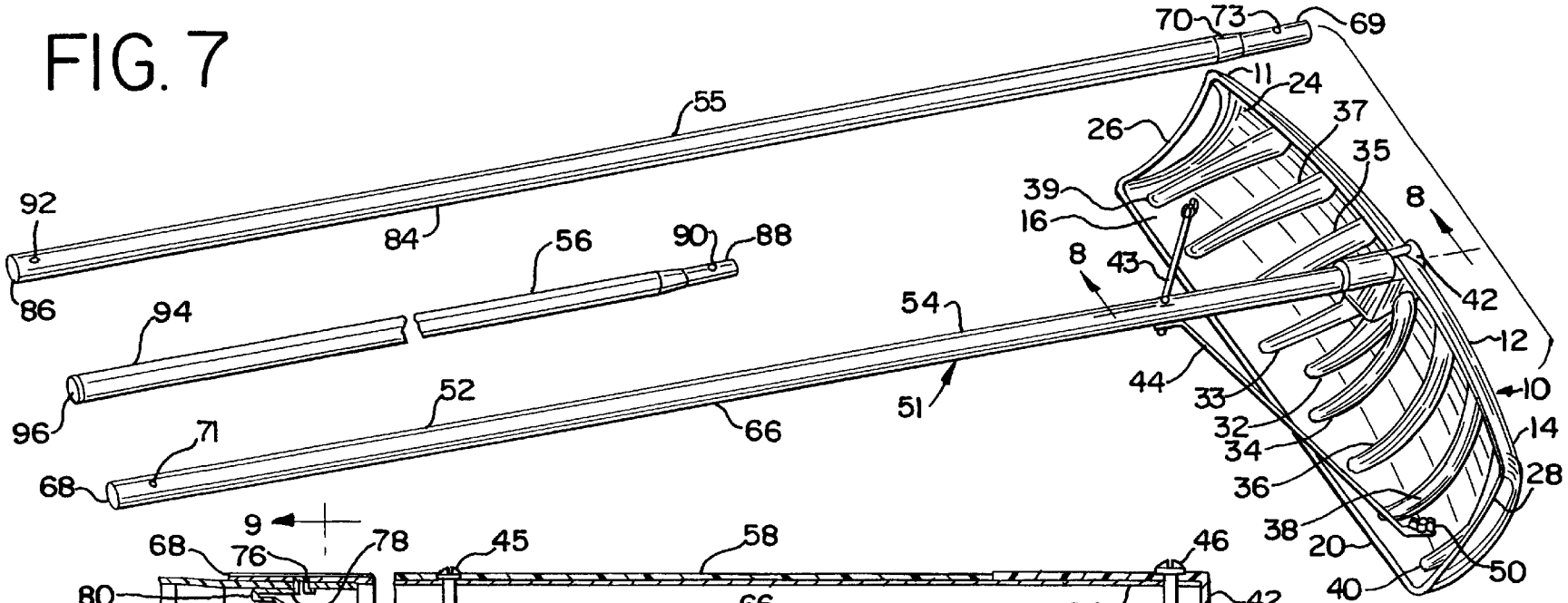
FIG. 7 is an assembly view of the roof rake.

As shown in FIG. 7, the intermediate shaft has an elongated tubular body 84 that extends between the front adjoining end portion and the back (rearward) adjoining end portion 86 of the intermediate shaft. The rearward adjoining shaft can be structural similar to the intermediate shaft and can have a structurally similar snap lock assembly so that the front (forward) end portion 88 of the rearward (back) shaft telescopically fits within, snap-fits, and interlockingly engages the back end portion of the intermediate shaft to securely connect and firmly lock the intermediate and rearward shafts of the handle assembly together in an expanded position. The pushbutton of the snap lock assembly of the rearward shaft snap fits, is inserted and extends through the pushbutton-receiving apertures 90–92 of the front end portion of the rearward shaft and the back end portion of the intermediate shaft when the handle is in an extended expanded position. The back (rearward) end portion 94 of the rearward shaft can be plugged and closed with a plastic end cap 96.

The snap lock connector assemblies of the roof rake snap fit, releasably secure, interlockingly engage and detachably lock the shafts of the handle in an extended expanded position. Preferably, the snap lock connector assemblies comprise manually depressible spring-biased pushbuttons. The pushbuttons are normally biased and urged to extend outwardly through the pushbutton-receiving apertures. The pushbutton can be depressed inwardly below the exterior surface of the back end portion of its connecting shafts to unlock the snap lock connector assemblies and permit the shafts to disconnect and disassemble for storage of the roof rake.

The roof rake provides a very useful, light-weight snow tool for efficiently removing snow from a roof.

Among the many advantages of the roof rake of this invention are:

1. Readily removes snow from roofs.
2. Outstanding performance
3. Easily to assemble.
4. Prevent gouging, puncturing or otherwise damaging the roof during use.
5. Superior snow removal from roofs.
6. Excellent snap lock assemblies which firmly lock the handle in an expanded position.
7. Sturdy.
8. Strong.
9. Attractive.
10. Safe.
11. Dependable.
12. User-friendly.
13. Convenient.
14. Durable.
15. Portable.
16. Light-weight.
17. Comfortable.
18. Simple to use.
19. Efficient.
20. Versatile.
21. Economical.
22. Effective.

Although embodiments of the invention have been shown and described, it is to be understood that various modifications and substitutions, as well as rearrangements of parts and components, can be made by those skilled in the art without departing from the novel spirit and scope of this invention.

What is claimed is:

1. A roof rake, comprising:

a blade assembly having a plastic curved roof rake-blade for pulling and removing snow from a roof and defining a rearwardly extending socket portion providing a handle-receiving coupling joint, said roof rake-blade having symmetrical curved ribs extending laterally outwardly from said socket, said roof rake-blade having a convex front face and a concave back face for pulling and curling snow from the roof, said roof rake-blade having an upper edge in proximity to said socket portion and a lower leading edge positioned at a level below said socket portion, the blade having a convex front blade surface and a convex rear blade surface defining a concave blade, the blade further having inwardly curved side walls and a substantially straight lower edge;

an elongated expandable handle assembly comprising a set of metal tubes providing shafts including a forward blade assembly-engaging shaft and an adjoining shaft, each of said shafts having opposite end portions, said forward blade assembly engaging shaft having a front end portion positioned within and fixedly secured to said socket portion providing said handle-receiving coupling joint, said forward blade assembly engaging shaft having a back end portion and an elongated tubular body extending between said back end portion and said front end portion, said adjoining shaft having a front adjoining end portion for telescopically engaging the back end portion of said blade assembly-engaging shaft, and said front adjoining end portion of said adjoining shaft and said back end portion of said blade assembly-engaging shaft defining connecting portions with aligned pushbutton-receiving apertures; and a snap lock assembly comprising a manually depressible spring-biased pushbutton connected to one of said connecting portions of said shafts, said pushbuttom snap-fittingly engaging and extending through said apertures for securely connecting and locking said shafts together in an extended position to provided an elongated handle to pull said roof rake-blade.

2. A roof rake in accordance with claim 1 wherein said roof rake-blade and said socket comprise a plastic selected from the group consisting of polypropylene, polyethylene, polyvinyl chloride and graphite-impregnated plastic.

3. A roof rake in accordance with claim 1 wherein said ribs comprise generally V-shaped ribs.

4. A roof rake in accordance with claim 1 including a set of aliquotly spaced rounded plastic protuberances extending downwardly from said lower leading edge of said roof rake-blade for substantially preventing said lower leading edge from digging into and damaging the roof, said protuberances being selected from the group consisting of feet, teeth, tines, rudders, and ribs.

5. A roof rake in accordance with claim 1 wherein said shafts are constructed from aluminum tubes.

6. A roof rake in accordance with claim 1 including stabilizing struts comprising reinforcing braces extending between and connected to said concave back face of said roof rake-blade and said elongated tubular body of said blade assembly-engaging shaft.

7. A roof rake in accordance with claim 6 wherein said reinforcing braces comprise rearwardly converging rods comprising a metal selected from the group consisting of steel, aluminum, and iron.

8. A roof rake in accordance with claim 1 wherein said handle assembly comprises a plastic sleeve positioned at least about one of said shafts.

9. A roof rake in accordance with claim 8 wherein said sleeve comprises a plastic selected from the group consisting of polypropylene, polyethylene, polyvinyl chloride, and graphite-impregnated plastic.

10. A roof rake in accordance with claim 8 wherein said plastic sleeve extends for substantially the length of said one shaft between said end portions.

11. A roof rake in accordance with claim 8 wherein said plastic sleeve comprises longitudinally extending ribs and an array of longitudinal extending grooves between said longitudinally extending ribs.

12. A roof rake in accordance with claim 1 wherein said set of tubes of said handle assembly comprises three similar size aluminum tubes, and said aluminum tubes are connected to each other by similar snap lock assemblies.

13. A roof rake in accordance with claim 1 including an end cap for plugging an end portion of one of said shafts.

* * * * *